US005497597A

United States Patent [19]

Elzenbeck

[11] Patent Number: 5,497,597

[45] Date of Patent: Mar. 12, 1996

[54] FRAME WITH INSERTED BOARD

[75] Inventor: Manfred Elzenbeck, Steinheim/Murr, Germany

[73] Assignee: Froscher Aspect GmbH & Co. KG, Steinheim/Murr, Germany

[21] Appl. No.: 142,394

[22] PCT Filed: May 20, 1992

[86] PCT No.: PCT/EP92/01126

§ 371 Date: Dec. 30, 1993

§ 102(e) Date: Dec. 30, 1993

[87] PCT Pub. No.: WO92/20258

PCT Pub. Date: Nov. 26, 1992

[30] Foreign Application Priority Data

May 22, 1991 [DE] Germany ..... 9106280 U

[51] Int. Cl.[6] ..... A47B 13/08

[52] U.S. Cl. ..... 52/782.24; 52/476; 52/773; 52/782.2; 52/800.11; 108/27; 108/157

[58] Field of Search ..... 52/783, 784, 476, 52/482, 773, 822, 782.2, 782.21, 782.22, 782.23, 782.24, 800.11; 108/27, 13, 157, 159, 153, 180; 403/327, 330, 326

[56] References Cited

U.S. PATENT DOCUMENTS

| | | | |
|---|---|---|---|
| 1,850,420 | 3/1932 | Schuldt | 108/13 |
| 2,562,426 | 7/1951 | Hunter | 108/157 X |
| 2,583,439 | 1/1952 | Oswald et al. | 52/476 |
| 2,903,312 | 9/1959 | Lawless | 108/159 X |
| 4,586,399 | 5/1986 | Kassai | 403/330 X |
| 4,752,150 | 6/1988 | Salice | 403/330 |
| 4,823,436 | 4/1989 | Salice | 403/327 X |
| 4,956,956 | 9/1990 | Maier et al. | 52/126.1 X |
| 4,971,474 | 11/1990 | Sprague | 403/327 X |
| 4,996,817 | 3/1991 | Nelson | 52/783 |

FOREIGN PATENT DOCUMENTS

| | | | |
|---|---|---|---|
| 338443 | 10/1989 | European Pat. Off. | 403/327 |
| 2516068 | 4/1976 | Germany . | |
| 8524035 | 10/1985 | Germany . | |
| 524105 | 7/1940 | United Kingdom | 108/27 |

*Primary Examiner*—Carl D. Friedman
*Assistant Examiner*—Laura A. Saladino
*Attorney, Agent, or Firm*—Jones, Tullar & Cooper

[57] ABSTRACT

A frame and an inserted board mounted on the frame is related. The frame includes a circumferential frame edge, a frame receiver corresponding to the shape of the board and a circumferential frame support edge supporting an edge of the board, the supporting edge extending in the direction toward the interior of the frame. The board includes a circumferential edge, a spring-elastically pivotable blocking member situated at at least two oppositely situated portions of the circumferential edge of the board, each blocking member projecting beneath a portion of the frame edge, and an adjustable operating element associated with each blocking member.

13 Claims, 2 Drawing Sheets

FRAME WITH INSERTED BOARD

BACKGROUND OF THE INVENTION

The present invention relates to a frame with an inserted board, particularly a table top, wherein the frame has a frame receiver corresponding to the shape of the board or table top, and a circumferential frame support edge supporting the board edge and oriented toward the interior of the frame. In this case the frame receives the board or table top and also directly supports it. In the case of a table, the frame is equipped with at least three table legs. However, if the frame is otherwise supported, for example on consoles or the like, or as an intermediate board between two tables, the legs are of course omitted, but in this case the board is also directly supported on the frame.

Frames or tables with inserted boards are already known per se. The board is maintained in the frame because of its inherent weight.

SUMMARY OF THE INVENTION

It is an object of the present invention to maintain the table top in the frame by means in addition to its inherent weight, so that at least it cannot simply be removed out of the frame.

This object is attained in accordance with the present invention in that it is proposed to embody the frame with the inserted board such that the board, particularly the table top, on at least two edges or edge parts, which are located approximately opposite each other, has respectively a spring-elastically pivotable member which projects underneath an interior frame projection or interior frame edge facing the board edge, which can be put into a release position by means of an adjustable operating element supported on the frame. Since this board is maintained in the frame on at least two oppositely located edges or edge parts, it can only be removed out of the frame, if necessary, if previously each blocking member has been brought into a non-effective position. This is true for a round or an oval frame as well as a frame with corners, the latter being required to have three or more corners.

Because the blocking member projects below the associated frame projection or an interior edge of the frame protruding inward, the board can neither be pushed up from below nor be removed in another way, the latter being difficult anyway when the board has been inserted deep enough or completely into the frame. In addition, the weight of the board also plays a decisive role during removal or problem-free removal.

By operating the operating element associated with each blocking member it is possible to cancel the blocking action of the associated blocking member, so that this frame edge is released. However, since at least two blocking members per board are provided, it is necessary to bring all of them into the non-effective position by means of their associated operating elements and to keep them there sufficiently long until the board has been lifted out of the frame at least far enough that the blocking members no longer can assume the blocking position.

An embodiment of the present invention provides for the blocking member to be embodied as a spring-elastic lever with a blocking projection or to support a lever of this type, wherein the projection extends below the frame projection or interior edge of the frame. A separate blocking member spring can be omitted because of the inherent resilience of the blocking member, because of which the structure becomes simpler, less expensive and more sturdy. The size and shape of the blocking projection depends on the local conditions, i.e. particularly the shape and size of the frame projection or the interior edge of the frame. The latter can be created, for example, by undercutting or it can immediately be embodied by providing a profile on it.

A further embodiment of the present invention is distinguished in that the flexible lever of the blocking member has a detent which projects in the same direction as the blocking projection and which engages a locking recess when the blocking member is locked. While the detent prevents the lifting of the board out of the frame, by means of the detent and the recess in the frame a movement of the board in the plane of the board relative to the frame is achieved. The shapes of the detent and the recess of the frame are of course adapted to each other. As can be seen from the exemplary embodiment, the detent has in a preferred manner the shape of a section of a sphere or a hemisphere, which can be directly formed out of the flexible lever. As a consequence, the recess in the frame is also hemi-spherical.

A particularly preferred embodiment of the present invention ensues is characterized in that the blocking member essentially has the shape of a U-shaped shackle, wherein one U-leg and the other U-leg form the flexible lever, and in that the board has a pocket-shaped recess, thee edge of which is open in the direction toward the edge section, the size of which corresponds to that of the blocking member and over the opening of which at least the unstressed blocking projection as well as a detent protrude. In this case, the blocking member can be pushed into the recess in the board and frictionally held there. The blocking projection and the detent extend beyond the edge of the opening of the pocket-shaped recess. It is of course also possible for the flexible lever itself to project slightly partially outward in this area. However, care should be taken in this case that the locking of the blocking projection and also of the detent is not hampered by this. Plastic with the appropriate properties presents itself in particular as the material for this blocking member.

In a particularly advantageous manner the recesses for the blocking members are disposed in the center in respect to the board edge, so that the board can be inserted selectively with one or the other surface at the top, i.e. used as a changeable top.

A further variant of the present invention is characterized in that the operating element is embodied as a type of spring-loaded pivotable key which can be placed against the blocking projection, in the course of which the blocking projection is in its release position in the operating end position of the operating element. The pivotable key mentioned there is located at the top of the frame, so that it can be easily operated by depressing it. This pivot movement is converted into a pivoting-evasive movement of the blocking member or its flexible lever. In this case the pivot plane of the key extends in a vertical direction, for example, if the pivot axis of the key extends in the horizontal direction, while the pivot movement of the flexible lever is oriented in the horizontal direction, for example parallel to the plane of the board. The key or an appropriately designed part of the key which can be associated with the flexible lever rest against the outside of the blocking projection, at least following a specific pivot angle of the operating element. With increased depression of the operating element, the flexible lever is then pivoted via the blocking projection into the interior of the pocket-shaped recess. As soon as the blocking projection has left the frame projection or interior edge of the frame and in the course of this has at least partially entered into the pocket-shaped recess of the board, it is possible to lift the board at this place. If the operating element is released, it returns into the initial position because of the load spring, in the course of which the flexible lever is also released, so that it, too, again returns outward into the blocking position under the effect of the inherent resilience of its material.

It is greatly advantageous, for practical as well as esthetic reasons, if the outer surface of the operating element extends flush with the top surface of the frame. If the top surface of the frame is not level in this area, it is possible to give the exterior of the operating element a corresponding shape.

A further embodiment of the present invention is characterized in that the frame is hollow at least in the area of the operating element and in that a loaded spring, preferably embodied as a double leg spring, for the operating element is located in the interior, and in that the free end of the operating element projects behind the wall of a frame recess. The leg spring mentioned there must be of a size corresponding to the hollow of the frame in this area. On the other hand, however, it needs to be strong enough to assuredly push the operating element back into the initial position from any pivoted position. In accordance with the drawing figure, the term "double leg spring" is understood to pertain to two leg springs disposed at a lateral distance from each other and connected by an intermediate bar. This structure has the advantage of having a broad support base for the leg of the spring facing away from the key. The other leg or the other pair of legs rests against the inside of the operating element. The leg spring must be maintained in the frame in a suitable manner. It is easily possible to employ the turns of the leg spring halves for this. However, maintaining it in the interior of the frame by means of clamping or locking only is also conceivable.

BRIEF DESCRIPTION OF THE DRAWINGS

Further advantageous embodiments and advantages resulting therefrom ensue from the following description of an exemplary embodiment. Such an exemplary embodiment is, shown in the drawings. Shown are.

DETAILED DESCRIPTION OF THE PREFERRED EMBODIMENT

Figure 1:
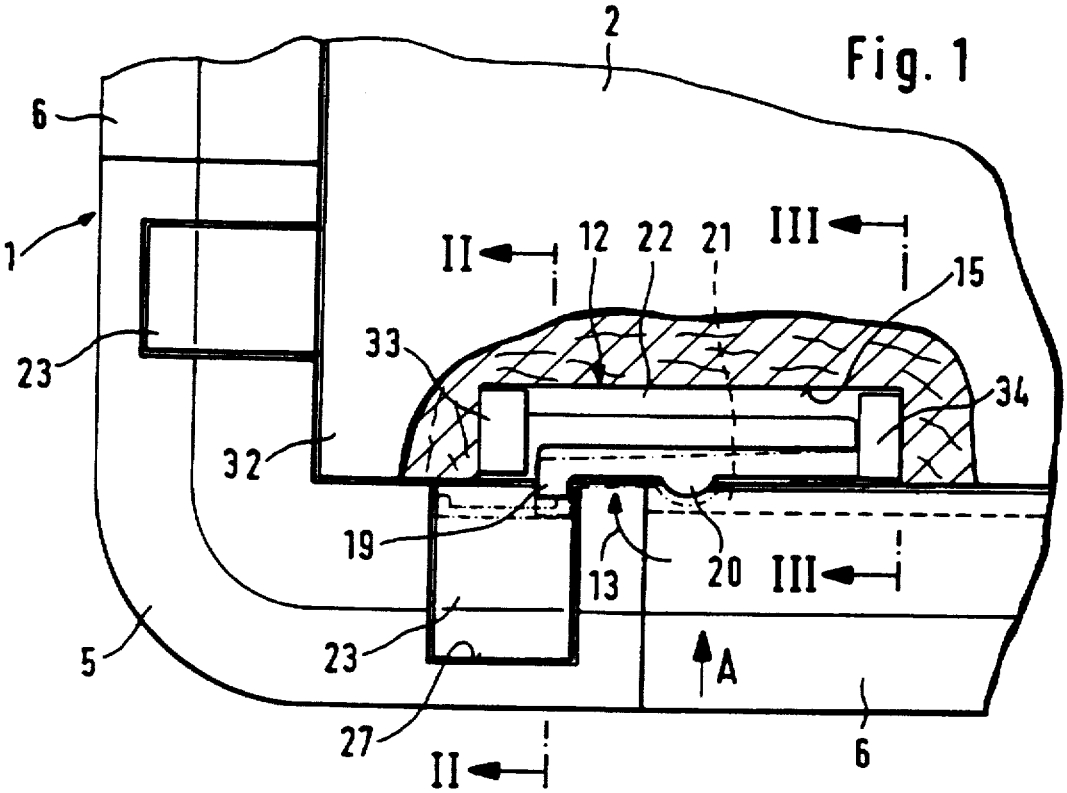
FIG. 1, a top view of a table corner with the table top broken open in the area of the blocking member.

A board 2 has been inserted into the frame 1, or a table frame. In the exemplary embodiment, the upper board surface 3 extends in a preferred manner approximately flush with the upper surface 4 of the frame 1. In addition, the frame 1 in the exemplary embodiment is square with rounded corners. The board 2 has a purely rectangular shape. In this case the frame 1 consists of four corner pieces 5 and four straight connecting pieces 6 respectively inserted between two corner pieces. In accordance with FIGS. 2 and 3, the corner pieces and the straight connecting pieces are hollow sections. Roughly speaking, the cross section of the frame pieces, including the corner pieces, can be considered to be angle-shaped, with a horizontal angle leg 7 and an upward extending vertical angle leg 8. The board 2 rests on the horizontal angle legs, which constitute a circumferential support edge. The remaining design of the sections and in particular of the exterior section edge 9 have no importance in connection with the embodiment of the present invention. It can be designed within the scope of the esthetic requirements or wishes of the customers.

The top surface of the one or horizontal angle leg 7 forms a circumferential frame support edge 10 for the edge area of the board 2. The board 2 is locked in respect to the frame 1 at two edges or edge parts which are located approximately opposite each other. For this purpose it is provided with a spring-elastically pivotable blocking member 12 at the appropriate edges 11. This can be pivoted in the direction of the arrow 13 (FIG. 1). For this purpose the board 2 is provided with a pocket-shaped recess 15 for each blocking member 12, the opening of which is respectively located in the associated board edge 14. The pocket-shaped recess is of such a size that the blocking member just fits into it and can preferably be kept in it in a clamping manner. As can be seen particularly well in FIG. 3, the spring-elastically pivotable blocking member extends below an interior frame projection or interior frame edge 16 facing the board edge. This has been created by an undercut 17 of the vertical angle leg 8. It can easily be seen that it is therefore not possible to lift the board 2 from the frame 1 in the direction of the arrow 18.

The blocking member 12 is provided with a spring-elastically flexible lever having a barb-like blocking projection 19 on its free end. In accordance with FIG. 3, this is the part which extends below the interior frame edge 16.

In addition to this blocking projection, the flexible lever of the blocking member also supports a detent 20 projecting in the same direction as the blocking projection 19, which engages a frame recess 21 of corresponding shape and size when the blocking member 12 is locked. When a section rather than a straight connecting piece is used, the appropriate part of the section is provided with a hole of the corresponding shape.

As can be seen particularly well in FIG. 1, the blocking member 12 essentially has the form of a U-shaped shackle, wherein the one U-leg forms a fastening leg 22 and the other U-leg the flexible lever with the blocking projection 19.

The spring tension of the blocking member 12 has been selected such that in the assembled state it always projects beyond the board edge 14. Therefore a special operation is required for unlocking. The operating element 23 is used for this and, in the exemplary embodiment, it is embodied as a type of a spring-loaded pivotable key. In accordance with FIG. 2, the operating element 23 is pivotable in the direction of the arrow 25 around an axis 24, i.e. it can be pressed into the interior of the section. If no hollow section is used, it is necessary for the section to receive an appropriate recess at this place.

Figure 2:
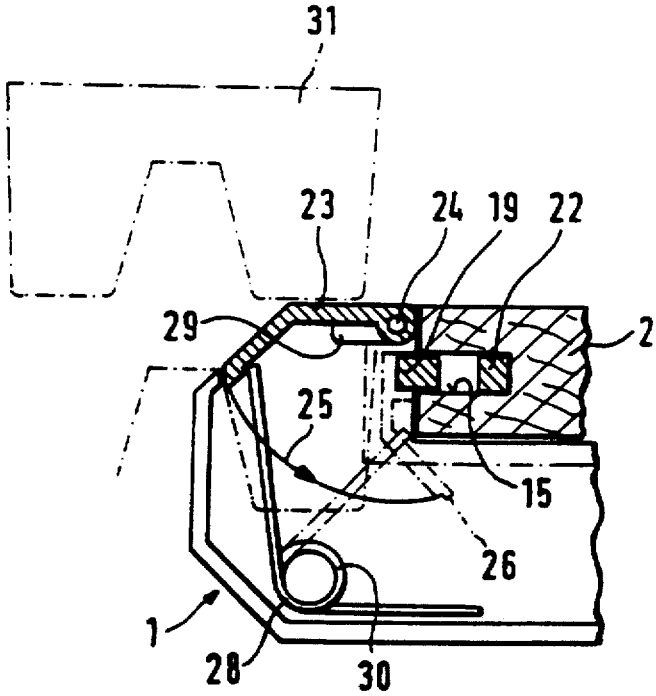
FIG. 2, a section along the line II—II of FIG. 1 with an operating tool.
Figure 3:
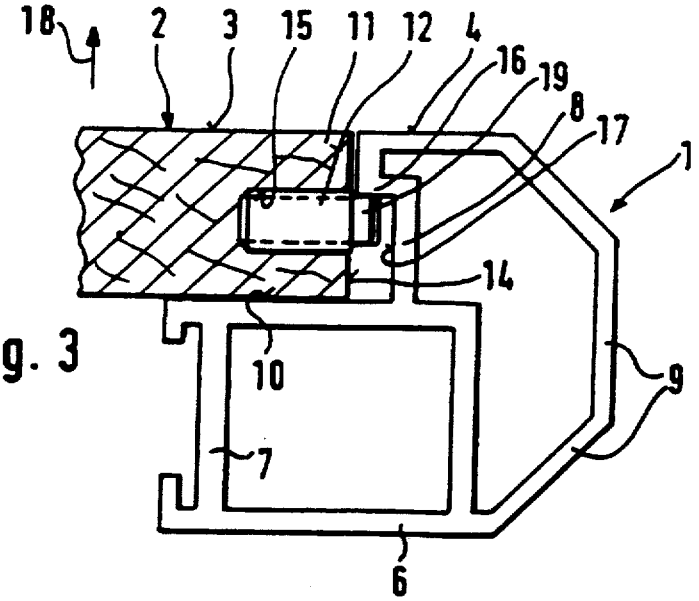
FIG. 3, which is a section along the line III—III of FIG. 1.

The operating member 23 in the form of a pivotable key is shown in FIG. 2 in solid lines in the initial position and in dashed lines in the pivoted end position, in which the blocking projection 19 has completely released the blocking member 12. It can also be seen in this drawing figure that the free end of the operating element 23 has a thin extension 26 on its underside with which it extends underneath the front edge of the recess 27 of the section or, more precisely, of the corner piece 5 in the exemplary embodiment. Because of this the load spring 28 cannot push the operating element 23 out of this recess. In an esthetically particularly advantageous manner, the outer surface of the operating element 23 extends flush with the surface of the frame section, which is angled in this area.

Figure 5:
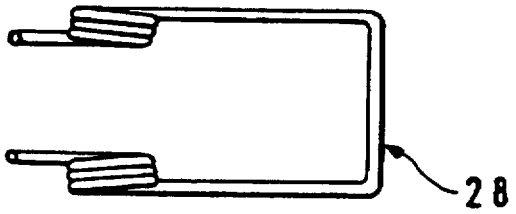
FIG. 5, which is a front view of the load spring for the operating element.

In the exemplary embodiment, the operating element 23 has a thickening portion 29 near its pivot axis 24. This is arranged in such a way that in the operational end position the flexible lever of the blocking member 12 is pushed into the pocket-shaped recess 15 sufficiently far that the blocking projection 19 as well as the detent 20 are freed. In accordance with FIG. 5, the load spring 28 is embodied as a double leg spring. It has sufficient space inside of the hollow section and is secured therein in a suitable manner, for example by pushing a bolt fastened in the section through its turns 30.

It can be seen in FIG. 2 that the operating element 23 can be operated not only by hand, but also with the aid of a double hook used for inserting an intermediate board and fastened thereon or also with the aid of an operating tool 31 of appropriate shape. This double hook or this tool is indicated by dashed lines in an initial position and by dash-dotted lines in the inserted position or operational end position. The double hook has an approximately U-shaped cross section, wherein one U-leg can dip into the recess 27 of the profile of a table and in the course of this causes the pivoting of the operating element 23 against the resistance of the spring 28. If a frame is equipped at several places with a blocking device for the inserted board 2 operated in this way, it is possible to maintain all operating elements in the pivoted-down position with the aid of the double hooks or also respectively an operating tool, and then remove the board 2 out of the frame 1. To the extent that it extends flush with the frame at the top, as provided in the exemplary embodiment, it is necessary to lift the board from below through the frame sufficiently far until it can be grasped from above. In a practical manner, the board is also inserted with all operating elements in this position. Locking then takes place automatically once all operating tools have been pulled out.

It can be seen from FIG. 1 that two operating elements 23, which are at equal distances from the corner edge, are associated with the board corner area 32. Thus, in the case of a rectangular table its frame 1 is equipped with four operating elements 23. But it is not intended to assign a blocking member 12 to each one of these operating elements, two or four blocking members are completely sufficient, and in the latter case one is mounted at each long edge of the board. However, the entire structure can be used in a more versatile universal manner and finally, this design also represents an esthetically positive aspect. As a whole, the above explanations also show that this frame provided with a board 2 is a component which can be used in a very universal way which, although it is preferably used for tables, can also be otherwise used as a connecting board between two tables or the like. To this extent it is a pure building block system, which can be arbitrarily expanded. An indirect result of this is that the board by no means needs to be rectangular or even square, but that all other shapes of boards, from a triangle to a polygon, even to a round board, are possible.

Figure 4:
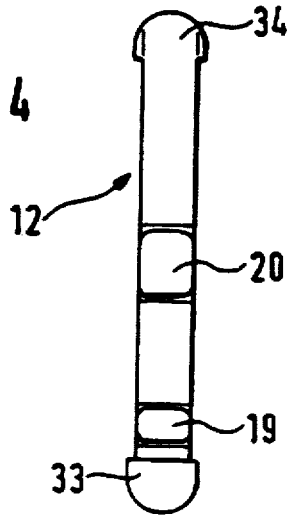
FIG. 4, which is a top view of the blocking member in the direction of the arrow A of FIG. 1.

It can be seen from FIGS. 1 and 4 that the blocking member has round, tang-shaped end pieces 33 and 34 at both of its ends, which contribute to good seating in the pocket-shaped recess 15 and which permit the making of this recess by means of an end-milling cutter.

I claim:

1. A frame and an inserted board mounted on the frame, wherein said frame includes a circumferential frame edge, a frame receiver corresponding to the shape of said board and a circumferential frame support edge supporting an edge of said board, said support edge extending in the direction toward the interior of said frame, and said board includes a circumferential edge, at least two spring-elastically pivotable blocking members, each blocking member situation at oppositely situated portions of said circumferential edge of said board, each blocking member projecting beneath a portion of said frame edge, and an adjustable operating element associated with each blocking member for locking and releasing said blocking member.

2. The frame and inserted board as defined in claim 1, wherein each of said blocking members is embodied as a spring-loaded flexible lever having a blocking projection which extends beneath said portion of said frame edge.

3. The frame and inserted board as defined in claim 2, wherein said flexible lever includes a detent which projects in the same direction as said blocking projection, wherein said frame includes a recess and wherein said detent engages said recess when said associated blocking member is locked.

4. The frame and inserted board as defined in claim 3, wherein said blocking member is formed as a U-shaped shackle, both legs of which form said flexible lever, wherein said board has a pocket shaped recess defining an edge which is open in the direction toward said circumferential edge, the size of said recess corresponding to the size of said blocking member, and wherein at least the blocking projection and said detent protrude over the recess edge when said blocking member is locked.

5. The frame and inserted board as defined in claim 3, wherein said frame includes a hollow portion in the area associated with said operating elements, wherein said frame further includes a load spring for each operating element located in the interior of said hollow portion, and wherein each operating element has a free end which projects behind said frame recess.

6. The frame and inserted board as defined in claim 5, wherein said load spring is embodied as a double-leg spring.

7. The frame and inserted board as defined in claim 2, wherein each operating element is embodied as a spring-loaded pivotable key which has an operating end position and which engages one of said blocking projections, in the course of which the blocking projection is in its release position at the operating end position of said operating element.

8. The frame and inserted board as defined in claim 1, wherein said board includes a plurality of recesses, each situated at the center of said circumferential edge of said board.

9. The frame and inserted board as defined in claim in claim 1, wherein each operating element defines an outer surface, said frame defines a top surface, and wherein the outer surface of each operating element is flush with the top surface of said frame.

10. The frame and inserted board as defined in claim 1, wherein said frame has an angle-shaped cross section, one leg of which projects inward and forms said circumferential frame support edge, and the other leg of which is vertical and encloses said circumferential edge of said board.

11. The frame and inserted board as defined in claim 10, wherein said board defines a surface, the vertical leg defines an upper free end, and wherein said upper free end of said vertical leg is flush with said board surface.

12. The frame and inserted board as defined in claim 1, wherein said board is rectangular in shape, with at least one corner of said board having a spring loaded operating element on each side of said at least one corner in said frame and at the same distance from said at least one corner.

13. The frame and inserted board as defined in claim 1, wherein said frame comprises corner pieces connected by straight connecting pieces, at least said corner pieces being hollow.

* * * * *

UNITED STATES PATENT AND TRADEMARK OFFICE

CERTIFICATE OF CORRECTION

PATENT NO. : 5,497,597

DATED : March 12, 1996

INVENTOR(S) : Manfred Elzenbeck

It is certified that error appears in the above-indentified patent and that said Letters Patent is hereby corrected as shown below:

Claim 1, column 6, line 7, "situation" should be --situated--.

Signed and Sealed this

Tenth Day of December, 1996

*Attest:*

*Attesting Officer*

BRUCE LEHMAN

*Commissioner of Patents and Trademarks*